US005732645A

United States Patent [19]

Lemke

[11] Patent Number: 5,732,645

[45] **Date of Patent: *Mar. 31, 1998**

[54] MARINE FENDING SYSTEM

[76] Inventor: Stuart H. Lemke, 349 River Bluff Rd., Mosinee, Wis. 54455

[ * ] Notice: The term of this patent shall not extend beyond the expiration date of Pat. No. 5,355,822.

[21] Appl. No.: 544,545

[22] Filed: Oct. 18, 1995

[51] Int. Cl.[6] ..... B63B 59/02

[52] U.S. Cl. ..... 114/219; 114/343

[58] Field of Search ..... 114/343, 361, 114/364, 218, 219

[56] References Cited

U.S. PATENT DOCUMENTS

| | | | |
|---|---|---|---|
| 3,693,573 | 9/1972 | Murphy | 114/219 |
| 3,988,997 | 11/1976 | Fenton | 114/219 |
| 4,653,419 | 3/1987 | Brandon | 114/219 |
| 4,841,893 | 6/1989 | Ellison | 114/219 |
| 4,843,994 | 7/1989 | Wilson et al. | 114/219 |
| 4,915,662 | 4/1990 | Kent | 441/127 |
| 4,998,495 | 3/1991 | Bos et al. | 114/219 |
| 5,042,166 | 8/1991 | Arnold | 114/361 |
| 5,207,171 | 5/1993 | Westwood, III | 114/219 |
| 5,299,521 | 4/1994 | Loucks | 114/219 |
| 5,355,822 | 10/1994 | Lemke | 114/219 |

*Primary Examiner*—Ed L. Swinehart

*Attorney, Agent, or Firm*—Thomas D. Wilhelm; Brian R. Tumm

[57] ABSTRACT

A marine fender assembly includes a slip sheet for contacting a dock or other second object when a boat is moored. A cushion sheet is connected to the slip sheet, to make a shock absorbing subassembly for absorbing shock of lateral movement of the boat relative to the second object. The cushion sheet may be disposed between the slip sheet and the boat hull. In some embodiments, the slip sheet comprises two layers and a space between the two layers, and the cushion sheet is contained between the two layers, within the slip sheet. A fastener subassembly is secured to the shock absorbing subassembly, typically at the top of the shock absorbing subassembly so that the shock absorbing subassembly may be suspended downwardly along a portion of the boat hull. In some embodiments, attachment of the cushion sheet to the slip sheet is limited to loci adjacent the top of the cushion sheet, whereby sliding movement between the boat and the e.g. dock may be absorbed and/or dissipated within the shock absorbing subassembly rather than at the outer surface of the boat hull.

55 Claims, 5 Drawing Sheets

MARINE FENDING SYSTEM

FIELD OF THE INVENTION

This invention relates to boats and boating, and particularly to apparatus and methods for protecting boats from being damaged when urged against docks and other objects by wind, waves, or like forces acting in the water.

BACKGROUND OF THE INVENTION

When a boat in the water is tied up to another object such as a stationary dock, a floating dock, a barge, a dive platform, or another boat, action of waves and wind may move the boat about with respect to the object to which it is tied, resulting in the boat impacting against the other object. Where the object is stationary, such as a dock, only the boat is moving. Where the object is another floating object, both the boat and the object to which it is tied may be moved by similar action of wind and waves; but with the same result of impacting the boat against the other object.

This invention relates to boat hull protectors and more specifically to a fender that can be used to protect a boat hull when the boat is moored to a dock, whether stationary or floating, or to another object such as another boat.

In the past, boat fenders have been made with a variety of materials and configurations to protect a boat from damage when moored at a dock.

The typical boat fender is round or cylindrical in shape. Such typical round fender is merely suspended downwardly from the boat at the upper end of the fender relative to e.g. a dock, and may hang there between the boat and the dock.

In such fenders, especially lateral front-to-rear motion of the boat along the bow-to-stern axis of the boat tends to cause angular motion of the fender about the upper end of the line suspending the fender, and also about the upper end of the fender. This angular motion tends to raise the lower end of the fender, and thus the entire body of the fender, above the dock, whereby the fender is no longer positioned between the boat and the dock.

With the fender thus moved out of the space between the boat and the dock, the boat is allowed to come into contact with the dock and to bump directly against the dock in response to ordinary wave and wind action, typically resulting in damage to the boat hull.

Even if the fender maintains its position between the boat hill and the dock, the typical motion of the boat in even modestly active wind or waves causes the fender to roll, slide, and scrape against the boat hull. Of course, in routine use, a moored boat may experience frequent and extended periods of incessant motion of the boat relative to the dock, and thus corresponding extended periods of motion between the boat and the round fender.

Even though such a conventional round fender may be made with a soft material, such as a soft plastic, the incessant motion between the fender and the boat tends to mar the boat finish, especially where the hull has a highly polished surface such as the conventional gel coat of a typical fiberglass hull. In particular, the fender contacts the dock as well as the boat. As the fender contacts the dock, it picks up surface debris, such as small stones or pieces of wood, and other types of relatively abrasive debris that become attached to an actively used dock. As the fender rolls between the boat and the dock, the debris on the surface of the fender comes into contact with the boat hull, resulting in at least abrasive damage to the hull of the boat.

Certain improvements in marine fending technology are disclosed in my U.S. Pat. No. 5,355,822, issued Oct. 18, 1994, which patent is herein incorporated by reference in its entirety.

It is an object of the present invention to provide a simple, inexpensive and readily used marine fender that can protect the boat finish when the boat is moored to a dock, to another boat, or to some other object in or adjacent the water.

It is a more specific object to provide a marine fender having a slip sheet disposed for contacting with the dock when the boat is moored.

Another object is to provide a marine fender wherein a cushioning sheet is connected to the slip sheet and disposed between the slip sheet and the boat hull when the boat is moored.

Yet another object is to provide a fastening subassembly disposed at the upper edge of one of the slip sheet and the cushion sheet, and extending upwardly to the boat, so that the protective portion of the fender can be suspended downwardly along a portion of the boat hull.

Still another object is to provide a marine fender wherein connection between the cushion sheet and the slip sheet is limited to the upper edge of the slip sheet, to allow for relative vertical movement between the slip sheet and the cushion sheet so that a substantial portion of any sliding movement between the boat and the dock is absorbed by corresponding sliding movement internal to the protective portion of the fender.

In accordance with still another aspect of the invention, the fastening means are adjustable so that the position of the bumper fender along the boat hull may be varied.

The present invention thus provides a bumper fender that is easily used with many types of boats and which minimizes a rubbing or sliding action at the surface of the boat.

SUMMARY OF THE DISCLOSURE

Some of the objects are obtained in a first family of embodiments, comprehending a marine fender assembly for mounting to a boat, and for thus being interposed between the boat and a second object, thereby protecting the hull of the boat when the boat is moored to the second object, the marine fender assembly comprising a slip sheet; a cushion sheet mounted to the slip sheet; and a fastener subassembly secured to one of the slip sheet and the cushion sheet for hanging the marine fender assembly downwardly from a mounting locus on the boat and thereby interposing the marine fender assembly between the boat and the second object, the cushion sheet contacting and following movement of the boat hull, the slip sheet contacting and following movement of the second object, whereby sliding movement resulting from movement of the boat relative to the second object is substantially absorbed and dissipated by corresponding sliding movements within the marine fender assembly.

In some embodiments, the fastener subassembly comprises a strap, preferably adjustable in length, extending from at least one of the slip sheet and the cushion sheet for encircling engagement with a rail on the boat, and includes first and second spaced connectors engageable with each other to define a loop around the rail.

In other embodiments, the fastener subassembly comprises first and second spaced straps each extending from at least one of the slip sheet and the cushion sheet, for hanging the marine fender assembly downwardly from a mounting locus on the boat and thereby interposing the marine fender assembly between the boat and the second object.

A connector on the strap, or straps, is preferably engageable with a mating connector on the boat. A preferred connector on the strap has opposing first and second engagement elements on opposing sides thereof corresponding to opposing sides of the strap, whereby the first engagement element engages a respective mating connector on the boat, and the second engagement element engages a corresponding connector on a third object to thereby secure the third object to the boat, through the connector mounted on the strap.

In some embodiments, the cushion sheet has a top and a bottom, left and right sides, a front and a back, a thickness between the front and the back, and first and second layers separated by an intervening cut, between the front and the back, extending from the left side to the right side, and from the bottom to a locus at least adjacent the top.

Preferably, the cushion sheet is mounted to the slip sheet such that a first side of the cushion sheet disposed toward the second object (e.g. dock) is prevented from rotating into facing orientation with respect to the slip sheet.

Also preferably, the cushion sheet is mounted to the slip sheet such that both the slip sheet and the cushion sheet maintain a common orientation with respect to each other during normal movement of the moored boat.

Further, it is preferred that the cushion, sheet and the slip sheet be secured to each other to form a cushioned shock absorbing subassembly, with the fastener subassembly comprising first and second straps secured to the shock absorbing subassembly at laterally spaced locations, for hanging the shock absorbing subassembly downwardly from respective first and second spaced mounting loci on the boat. Yet further, it is preferred that the shock Absorbing subassembly have left and right sides, and that the first and second straps be secured respectively to the shock absorbing subassembly adjacent respective ones of the left and right sides.

The invention further comprehends a marine fender assembly for mounting to a boat, and for thus being interposed between the boat and a second object, thereby protecting the hull of the boat when the boat is moored to the second object, the marine fender assembly comprising a slip sheet; a cushion sheet mounted to the slip sheet such that a first side of the cushion sheet, disposed toward the second object, is prevented from rotating into facing orientation with respect to the slip sheet; and a fastener subassembly secured to at least one of the slip sheet and the cushion sheet for hanging the marine fender assembly downwardly from a mounting locus on the boat and thereby interposing the marine fender assembly between the boat and the second object.

Where the mounting of the cushion sheet to the slip sheet is effective to accommodate sliding movement at the interface between the slip sheet and the cushion sheet, sliding movement resulting from movement of the boat relative to the second object may be substantially absorbed and dissipated by corresponding sliding movement within the marine fender assembly, especially at the interface between the slip sheet and the cushion sheet.

In some embodiments, the cushion sheet may be secured to the slip sheet, preventing substantial movement of facing surfaces of the slip sheet and the cushion sheet with respect to each other.

The invention still further comprehends a marine fender assembly for mounting to a boat, and for thus being interposed between the boat and a second object, thereby protecting the hull of the boat when the boat is moored to the second object, the marine fender assembly comprising a slip sheet; a cushion sheet mounted to the slip sheet such that both the slip sheet and the cushion sheet maintain a common orientation with respect to each other during normal movement of the moored boat, and a fastener subassembly secured to at least one of the slip sheet and the cushion sheet for hanging the marine fender assembly downwardly from a mounting locus on the boat and thereby interposing the marine fender assembly between the boat and the second object.

In some embodiments, the mounting of the cushion sheet to the slip sheet is effective to prevent movement of the slip sheet with respect to the cushion sheet over substantially the entirety of facing surfaces of the slip sheet and the cushion sheet.

In some embodiments, the slip sheet may comprise first and second opposing layers, and a space between the first and second layers, with the cushion sheet being contained substantially within the space.

In preferred embodiments, the slip sheet has an upper edge when installed on the boat, the cushion sheet being mounted to the slip sheet such that the cushion sheet hangs from the slip sheet adjacent the upper edge thereof and is disposed between the slip sheet and the boat hull.

The invention also comprehends a marine fender assembly for mounting to a boat, and for thus being interposed between the boat and a second object, thereby protecting the hull of the boat when the boat is moored to the second object, the marine fender assembly comprising a slip sheet; a cushion sheet, the cushion sheet and the slip sheet being secured to each other to form a cushioned shock absorbing subassembly; and first and second elongate fastener assemblies secured to the shock absorbing subassembly at laterally spaced locations on the shock absorbing subassembly, for hanging the shock absorbing subassembly downwardly from a mounting locus on the boat and thereby interposing the shock absorbing subassembly between the boat and the second object.

Preferably, the shock absorbing subassembly has a top edge, and left and right ends communicating with the top edge, the elongate fastener assemblies being secured respectively to the shock absorbing subassembly adjacent the left and right ends, for upward securement therefrom to spaced locations on the mounting locus.

The invention is further seen to comprehend a marine fender assembly for mounting to a boat, and for thus being interposed between the boat and a second object, thereby protecting the hull of the boat when the boat is moored to the second object, the marine fender assembly comprising a slip sheet; a cushion sheet mounted to the slip sheet to form a cushioned shock absorbing subassembly; a fastener subassembly secured to at least one of the slip sheet and the cushion sheet for hanging the cushioned shock absorbing subassembly downwardly from a mounting locus on the boat and thereby interposing the shock absorbing subassembly between the boat and the second object; and a connector disposed on the fastener subassembly and engageable with a mating connector on the boat.

Still further, the invention contemplates a marine fender assembly for mounting to a boat, and for thus being interposed between the boat and a second object, thereby protecting the hull of the boat when the boat is moored to the second object, the marine fender assembly comprising a slip sheet; a cushion sheet mounted to the slip sheet, the cushion sheet having a top and a bottom, left and right sides, a front and a back, and a thickness between the front and the back, first and second layers separated by an intervening cut, between the front and the back, extending from the left side to the right side, and from the bottom to a locus at least adjacent the top; a fastener subassembly secured to at least one of the slip sheet and the cushion sheet for hanging the marine fender assembly downwardly from a mounting locus on the boat and thereby interposing the marine fender assembly between the boat and the second object, the intervening cut providing an increased angle of downward vertical draping to the cushion sheet relative to an uncut cushion sheet of the same thickness.

The invention further contemplates a method of mooring a boat to a second object, the boat having a boat connector thereon for receiving a mating connector, the method comprising the steps of mounting to the boat a marine fender assembly having a strap, and including engaging a mating connector on the strap with the boat connector; hanging the marine fender assembly from the boat connector over the side of the boat, to engage the second object; and positioning the boat in a location favorable for mooring the boat to the second object, interposing the marine fender assembly between the boat and the second object, and thereby protecting the boat from directly engaging the second object.

In preferred embodiments, the method includes having a plurality of spaced boat connectors engageable with the mating connector on the marine fender, and including the step of selecting a particular first one of the boat connectors, according to the relative positions of the boat and the particular second object to which the boat is being moored, for connecting the mating connector from the marine fender assembly thereto, to thereby enhance the protection, afforded the boat by the marine fender assembly when hung from the selected boat connector, relative to other such ones of the spaced boat connectors.

Also in preferred embodiments, the strap comprises a first strap, and the method includes the step of mounting a second strap from the marine fender assembly, the second strap being spaced from the first strap at the marine fender assembly and having a second mating connector, to a second one of the boat connectors, spaced from the first boat connector, such that the first and second straps extend in spaced relation to each other from the marine fender assembly to the boat connectors.

Figure 1:
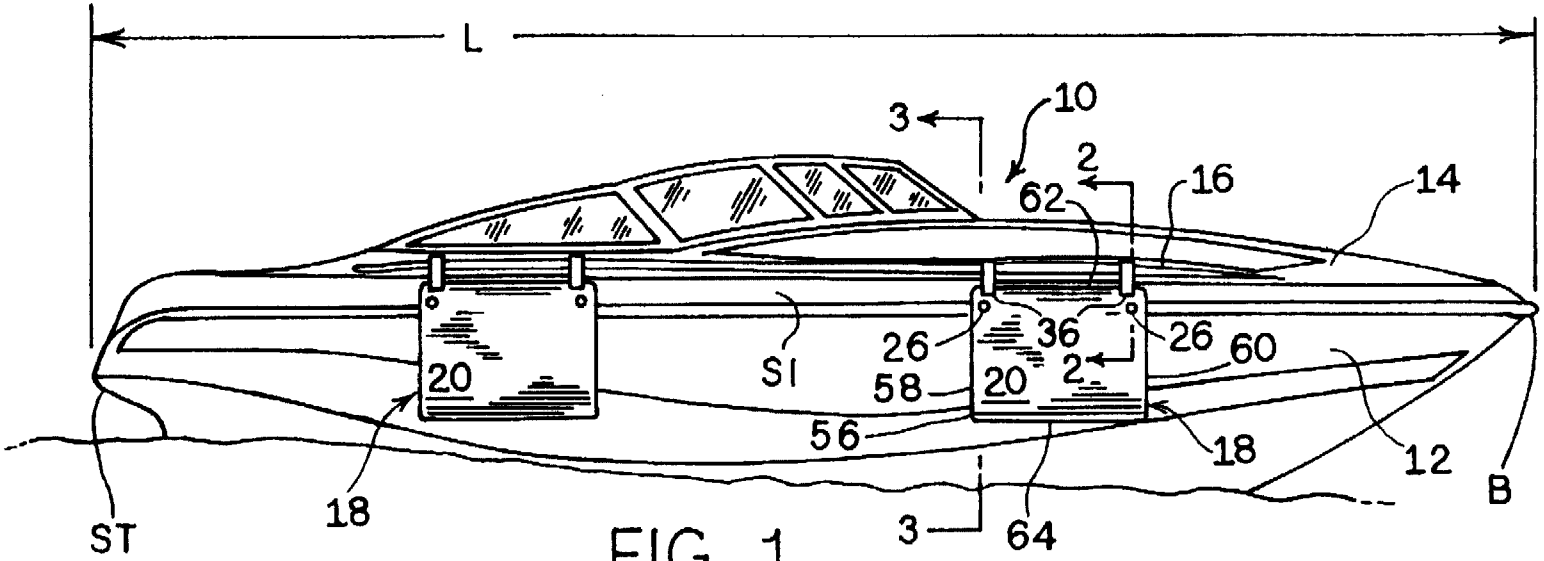
FIG. 1 is a perspective view of a boat utilizing the marine fending system of the invention.

The invention is not limited in its application to the details of construction and the arrangement of the components set forth in the following description or illustrated in the drawings. The invention is capable of other embodiments or of being practiced or carried out in various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Figure 2:
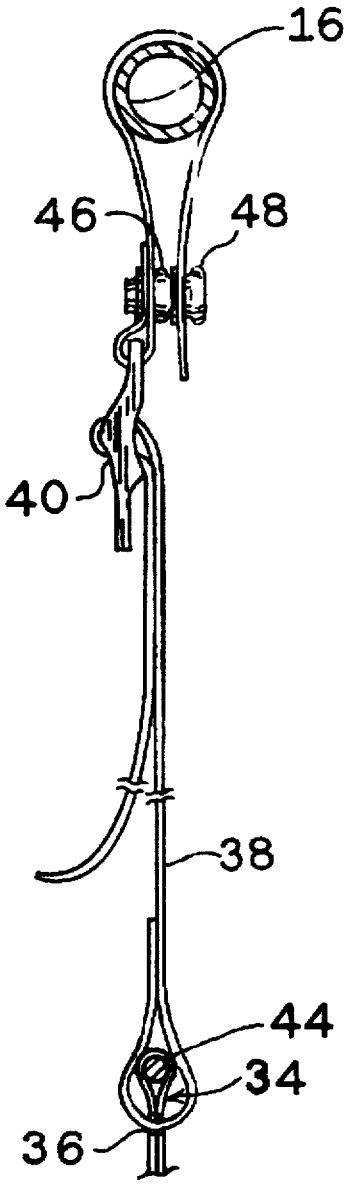
FIG. 2 is a sectional view along the line 2—2 of FIG. 1, showing an elevation view of the fastener strap.
Figure 3:
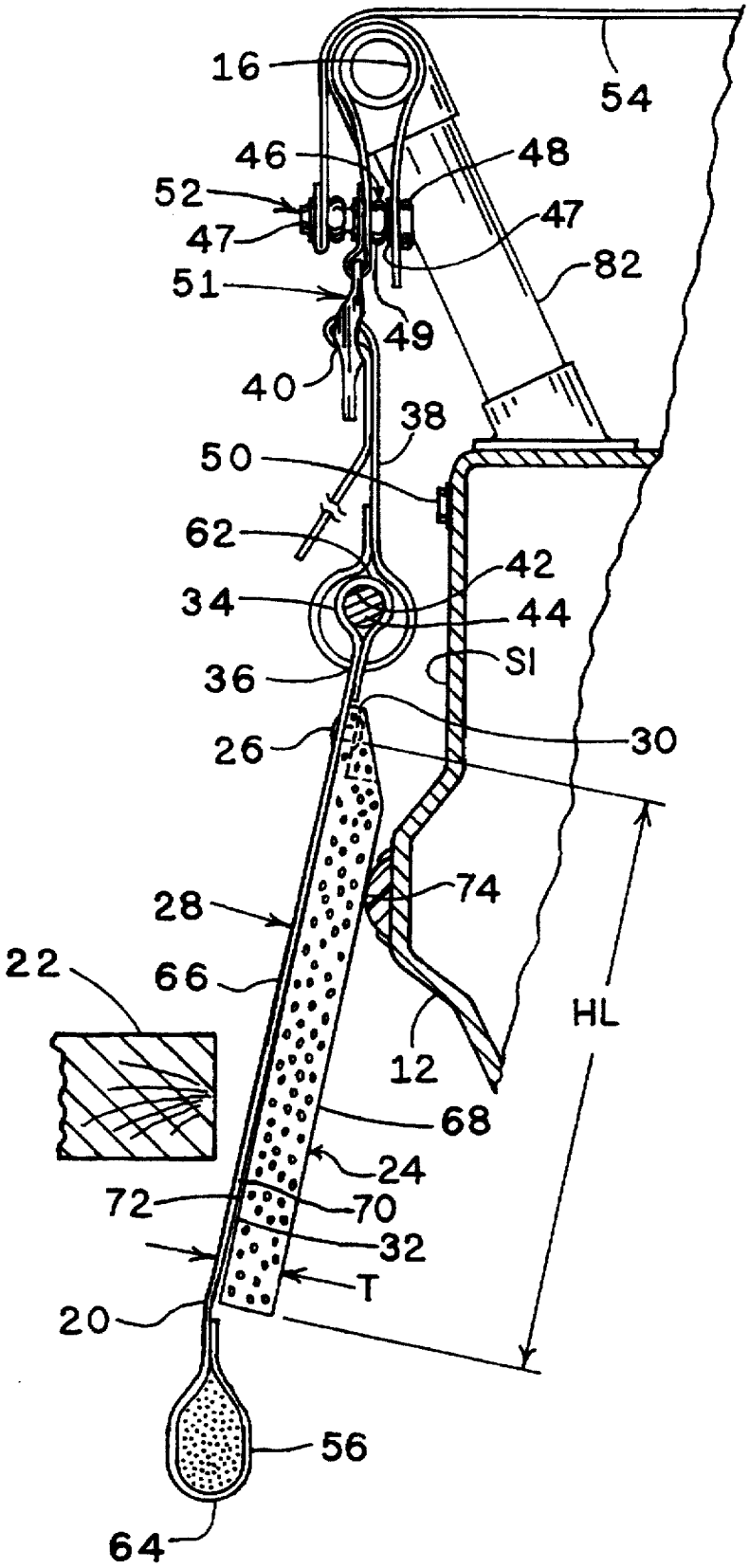
FIG. 3 is a sectional view along the line 3—3 of FIG. 1, showing a side elevation of the shock absorbing subassembly in cross-section.

Referring to FIGS. 1–3, a boat 10 has a hull 12, and a deck 14 on which a rail 16 is mounted. A pair of marine fender assemblies 18 is attached to and suspended from rail 16 so that when the boat is urged against a dock by wind, waves and the like, all contact with the dock is preferably made at the loci of, and through, the marine fender assemblies 18. The hull 12 includes a bow "B," a stern "ST," and opposing left and right sides "SI," only the right side being illustrated in the drawings. The boat further has a length "L" between the bow and stern.

A marine fender assembly 18 includes a substantially rectangular slip sheet 20 that is formed from a sheet of low friction polymeric material. Slip sheet is tough and rather flexible, having low surface friction, and thus high slip characteristics, such that the slip sheet tends to engage in slipping/sliding contact in preference to static frictional contact. A suitable material useful for constructing slip sheet 20 is a sheet of polyvinyl chloride copolymer about 0.045 inch thick, reinforced with 10×12 polyester scrim.

Slip sheet 20 is disposed on the outer side of marine fender assembly 18, away from the boat. The slip sheet 20 thus faces the dock 22 when boat 10 is moored to the dock, and engages in surface-to-surface contact with the dock when the boat is urged against the dock.

A substantially rectangular cushion sheet 24 in the form of a relatively low density resilient foam pad, and having a thickness "T," is connected to the upper portion of slip sheet 20 by a plurality of rivets 26 or other suitable fasteners, whereby the combination of the slip sheet 20 and the cushion sheet 24, as secured together, comprises a shock absorbing subassembly 28. Cushion sheet 24 is resiliently compressible, having good resistance to compressive stress, thus to absorb and dissipate shock forces exerted against the outer surface of the slip sheet 20.

Cushion sheet 24 is, fox example, made with a resiliently compressible ethylene vinyl acetate foam having a density of about 1 to about 10 pound per cubic foot, more preferably a density of about 1 to about 5 pounds per cubic foot. Most preferred density is about 2 pounds per cubic foot. Other resiliently compressible foam materials can be used, so long as they provide cushioning properties effective to protect the boat from impact-type damage during routine use.

Cushion sheet 24 is disposed inwardly of slip sheet 20, toward the boat hull. The cushion sheet thus faces, and is generally in contact with, the boat hull. Accordingly, any time the boat is in contact with the dock 22, such contact occurs through one or both of the marine fender assemblies 18 (FIG. 1), with slip sheet 20 making surface contact with the dock, cushion sheet 24 making surface contact with the boat, and slip sheet 20 and cushion sheet 24 making contact with each other internally within the marine fender assembly 18.

In the embodiment of FIGS. 1–3, cushion sheet 24 is connected to slip sheet 20 only adjacent the upper edge 30 of the cushion sheet 24. Thus, the lower portion of the shock absorbing subassembly is unattached to the cushion sheet and is thus free to move relatively toward and away from the cushion sheet, as well as vertically, as in a sliding engagement, with respect to the cushion sheet 24, along the limited height "HL" of the unattached lower portion of the slip sheet. All such movement is, of course, limited by the attachment of the slip sheet to the cushion sheet at the rivets 26.

Up, or especially down, movement of the boat results in the movement of slip sheet 20 along cushion sheet 22 at interface 32 between the slip sheet and the cushion sheet, rather than a slipping or rubbing motion of cushion sheet 24 on boat hull 12. Indeed, as the boat moves up or down relative to the dock, cushion sheet 24 generally remains in stationary contact with the boat hull while slip sheet 20 remains adjacent or in contact with the dock, depending on the spacing between the boat and the dock.

When the boat moves upwardly, with the slip sheet 20 extended along the cushion sheet 24 as shown in FIGS. 1 and 3, the slip sheet generally moves upwardly with the boat, and thus, to the extent the slip sheet is in surface contact with the dock, the slip sheet slips/slides upwardly in engagement with the dock. When the boat moves downwardly with little or no pressure against the dock, the slip sheet moves downwardly with the boat, even though the slip sheet may touch the dock, albeit with little if any pressure.

But when the boat moves downwardly while exerting lateral force against the dock, the unattached lower portion of the slip sheet 20 initially tends to remain stationary with respect to the dock. Since the cushion sheet moves with the boat, when the boat moves downwardly and the slip sheet remains stationary with respect to the dock, the slip sheet slips/slides with respect to the cushion sheet at interface 32. Thus, downward movement of the boat accompanied by lateral force of e.g. the boat against the dock results in a sliding movement of the marine fender assembly wherein the sliding movement between the boat and the dock is absorbed and dissipated, at least in part, by sliding movement of the slip sheet 20 with respect to the cushion sheet 24 within the marine fender assembly 18 at the interface 32.

The upper edge 34 of slip sheet 20 is provided with a pair of slots 36 in which a pair of fastening straps 38, are disposed. An adjustment buckle 40 in each fastening strap 38 allows the length of strap 38 to be varied. Upper edge 34 is also provided with a channel 42 in which plastic reinforcement rod 44 is disposed.

With appropriate reinforcement of cushion sheet 24, the straps 38 could as well be provided through corresponding slots (not shown) in cushion sheet 24 instead of, or in addition to, slots 36 in slip sheet 20.

The upper portion of each fastening strap 38 has lower and upper snap connectors 46, 48 respectively which are releasably engageable with each other, engagement being illustrated in FIG. 3. The combination of a strap 38, an adjustment buckle 40, and snap connectors 46, 48 comprehends a fastener subassembly 51 for securing the shock absorbing subassembly 28 to the boat.

When marine fender 18 is utilized with a boat having a rail 16, the upper portion of fastening strap 38 is passed over and around rail 16 and snap connectors 46, 48 are connected to each other so that marine fender 18 is suspended from boat rail 16. The vertical positioning of marine fender 18 along hull 12 can then be adjusted by adjusting the length of fastening strap 38 using adjustment buckle 40.

Figure 4:
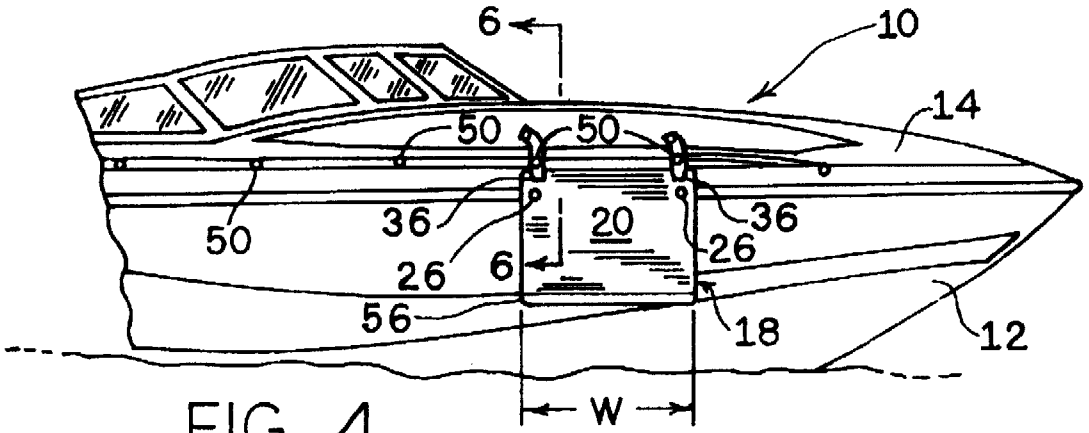
FIG. 4 is a perspective view of an alternate manner of attaching a marine fender assembly of the invention to a boat.
Figure 5:
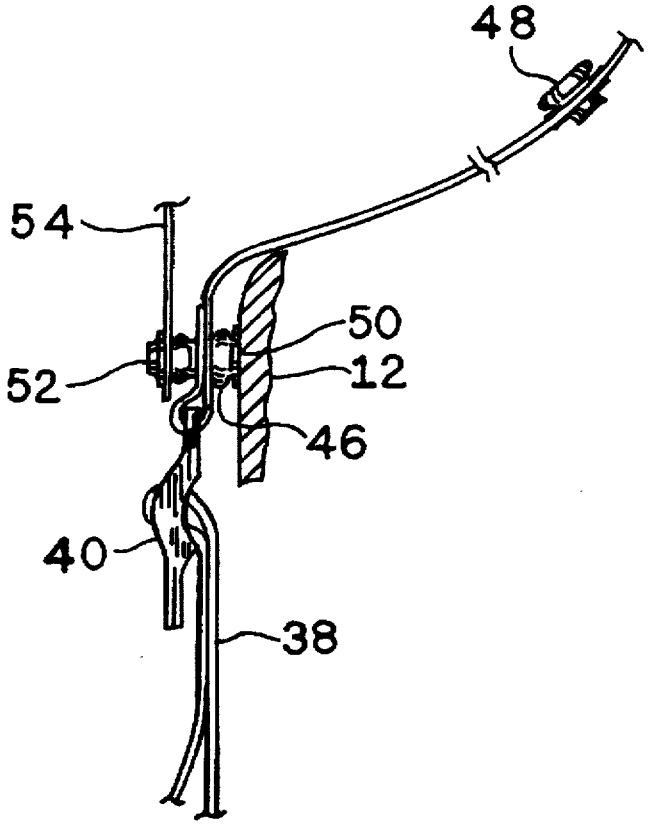
FIG. 5 is a sectional view taken along the line 5—5 of FIG. 4.

FIGS. 3–5 illustrate a use of the invention in which the boat is provided with a set of boat connectors 50 along the hull 12. The user selects the location along the hull which is most advantageous for hanging the fenders 18, and connects the snap connectors 46 or 48 to the respective snap connectors 50 at the selected location. Thus, any given fender 18 can be connected and hung near the bow, near the stern, amidships, or anywhere in between, so long as there are provided respective snap connectors 50 in the desired locations on the hull. With the snap connectors 46 or 48 snap connected to the respective boat connectors 50, the fender is draped downwardly over the side of the boat. Then, the lengths of the respective straps 38 are adjusted to thereby adjust the height of the fender 18 to interface with the dock 22.

As shown in for example FIG. 3, other objects can be mounted to, and/or secured to, the boat through the snap connectors 46, 48. The snap connectors 46, 48 preferably have first and second respective male and female engagement elements 47, 49 on opposing respective first and second sides of the respective snap connectors.

FIGS. 3 and 5 illustrate mounting a boat cover to the boat through the snap connectors 46, 48. Referring first to FIG. 3, female engagement element 49 on the first side of lower snap connector 46 is engaged with male engagement element 47 on the second side of upper snap connector 48 thereby securing the strap 38, and respectively the fender 18, to the rail 16 of the boat. FIG. 1 illustrates that a pair of such straps 38 are preferably used to suspend the marine fender 18 from the rail 16.

The male engagement element 47 on the second side of lower snap connector 46 may be used to connect an object, such as a boat cover 54 to the boat 10. FIG. 3 shows a snap connector 52 on boat cover 54, secured to the male engagement element 47 of the lower snap connector 46, thus securing the boat cover to the fender 18, and thus to the boat through rail 16.

FIG. 5 illustrates the use of the double-sided snap connector 46 to secure a boat cover directly to the boat. As shown there, the female engagement element 49 of lower snap connector 46 is engaged with a male engagement element on a boat connector 50 on the boat 10. Snap connector 52 of the boat cover 54 is engaged with the male engagement element 47 of snap connector 46, thus securing the cover 54 directly to the boat through the snap connector 46 of the fender 18. FIG. 4 illustrates using a respective pair of straps 38 to suspend the marine fender 18 from a corresponding pair of boat snap connectors 50.

While FIG. 5 shows the cover connected to the boat through lower snap connector 46, upper snap connector 48 could be used in place of snap connector 46 to secure the strap 38 to the boat at boat connector 50, in which case connector 52 would be connected to connector 48. FIGS. 3 and 5 thus illustrate attaching a boat cover, or any other object, to the boat through the connectors 46, 48, such as while the boat is moored to the dock 22 and protected by fender assembly 18.

A ballast 56 in the marine fender 18, filled with sand or the like, is provided at the lower end of the fender 18. Ballast 56 aids in maintaining the downwardly suspended position of the fender 18 along hull 12.

Referring now to FIGS. 1, 3, 4, and 6, the shock absorbing subassembly 28 has a left side 58, a right side 60, a top 62, a bottom 64, a dock surface 66 disposed against the dock 22, a boat surface 68 disposed against the boat, and a thickness "T" between the dock surface 66 and the boat surface 68. Slip sheet 20 and cushion sheet 24 meet at intermediate interfacial surface 70 on slip sheet 20 and intermediate surface 72 on cushion sheet 24.

Thickness "T" may be as small as about 0.5 inch, and up to about 4 inches or more, depending generally on the amount of lateral force to be exerted through the thickness of the fender 18 and the height and width dimensions of the shock absorbing subassembly 28. Preferred thicknesses "T" for light-weight e.g. pleasure boats are in the range of about 1 inch to about 2 inches. Such cushion sheets are sufficiently resistant to bending that cushion sheet 24 is generally effective to resist routine bending forces exerted against the foam cushion in routine use. Thus the foam cushion 24 is disinclined to being substantially bent, rotated, or otherwise twisted about any axis passing along either the height or the width, or otherwise through, the cushion sheet 24. Accordingly, the cushion sheet 24 maintains its boat surface 68 against the boat at all times.

Slots 36 are disposed adjacent the respective left and right sides 58, 60, adjacent the top 62. The slots 36 are spaced from each other at the respective left and right upper corners of the slip sheet 20. Straps 38 are mounted through the slots 36 adjacent respective left and right sides 58, 60 adjacent the top of the cushion sheet 24. Typical width "W" of the shock absorbing subassembly such as for a typical mass-produced pleasure boat may be for example 18 inches, from edge to edge, with the slots spaced from each other by about 10 inches.

In the preferred embodiments illustrated, reinforcement rod 44 provides rigidity along its length to thereby maintain the slip sheet 20 in a generally straight line configuration across the width "W" of the slip sheet, across the top 62. Correspondingly, ballast 56 provides a similar width-wise stiffening reinforcement across the width "W" of the slip sheet 20 adjacent the bottom 64.

Between reinforcement rod 44 and ballast 56, the slip sheet is quite flexible for bending about an e.g. horizontal axis. However, the slip sheet 20 cannot easily be bent about an upstanding axis, such as an axis passing through either reinforcement rod 44 or ballast 56. Accordingly, the slip sheet 20 generally does not rotate, bend, or otherwise flex about an upstanding axis, whereby flexing of the slip sheet is limited to flexing about horizontal and like-disposed low angle axes having angles less than about the angle required to pass diagonally through the slip sheet from corner to corner.

In general, then, the shock absorbing subassembly, as a whole resists bending, flexing, rotating, twisting, and like forces acting about substantially upstanding axes. Such resistance is provided, in combination as appropriate, through reinforcement rod 44, ballast 56, and the overall resistance of the foam of cushion sheet 24.

Suspension of such non-flexing assembly from the two (or more) straps 38 spaced from each other, and adjacent the top comers of the shock absorbing subassembly 28, assures that the marine fender resists rotation, twisting and like forces urging like action about the mounting points on the boat, whether about rail 16 or about a pair of snap connectors 50.

The conjugate resistance, of both the slip sheet 20 and the cushion sheet 24, to rotation about an upstanding axis ensures that the slip sheet and cushion sheet maintain constant orientation with respect to each other, and respective common orientation with respect to the boat and the dock.

Thus, the dock surface side of the slip sheet remains disposed away from the cushion sheet and away from the boat. Similarly, the boat surface side of the cushion sheet remains disposed away from the slip sheet and away from the dock. Accordingly, any debris or other abrasive or like material transferred from the dock to the dock surface side of the slip sheet remains directed away from the boat, and is thus not transferred to the boat by slip sheet 20.

Neither is such harmful material, in general, transferred to the cushion sheet 24, whereby it might otherwise be transferred to the boat by the cushion sheet. In general, no surface of cushion sheet 24 is routinely exposed to either the dock or the dock surface side of the slip sheet. Correspondingly, the boat surface side of cushion sheet 24 is not exposed to such debris or the like from the dock, whereby the boat surface remains relatively clean and free from deleterious dock-sourced material which could harm the hull.

Ballast 56 urges a vertical orientation on the fender assembly 18. The tendency for the fender assembly 18 to conform to a vertical orientation is most pronounced downwardly from the outermost surface of contact between the fender assembly 18 and the outer edge, illustrated at 74 in e.g. FIGS. 3 and 6, at the outer perimeter of the boat. Where cushion sheet 24 is relatively thin, the vertical orientation is more pronounced. Where the cushion sheet 24 is relatively thicker, the bending resistance of the foam is respectively greater such that, in some cases, absent appropriate accommodation, the lower portion of the marine fender assembly 18 may extend too far away from the hull to properly engage the dock and thereby protect the hull, whereby improved draping, as in a thinner foam with its lessened bending resistance, may be desired.

Figure 6:
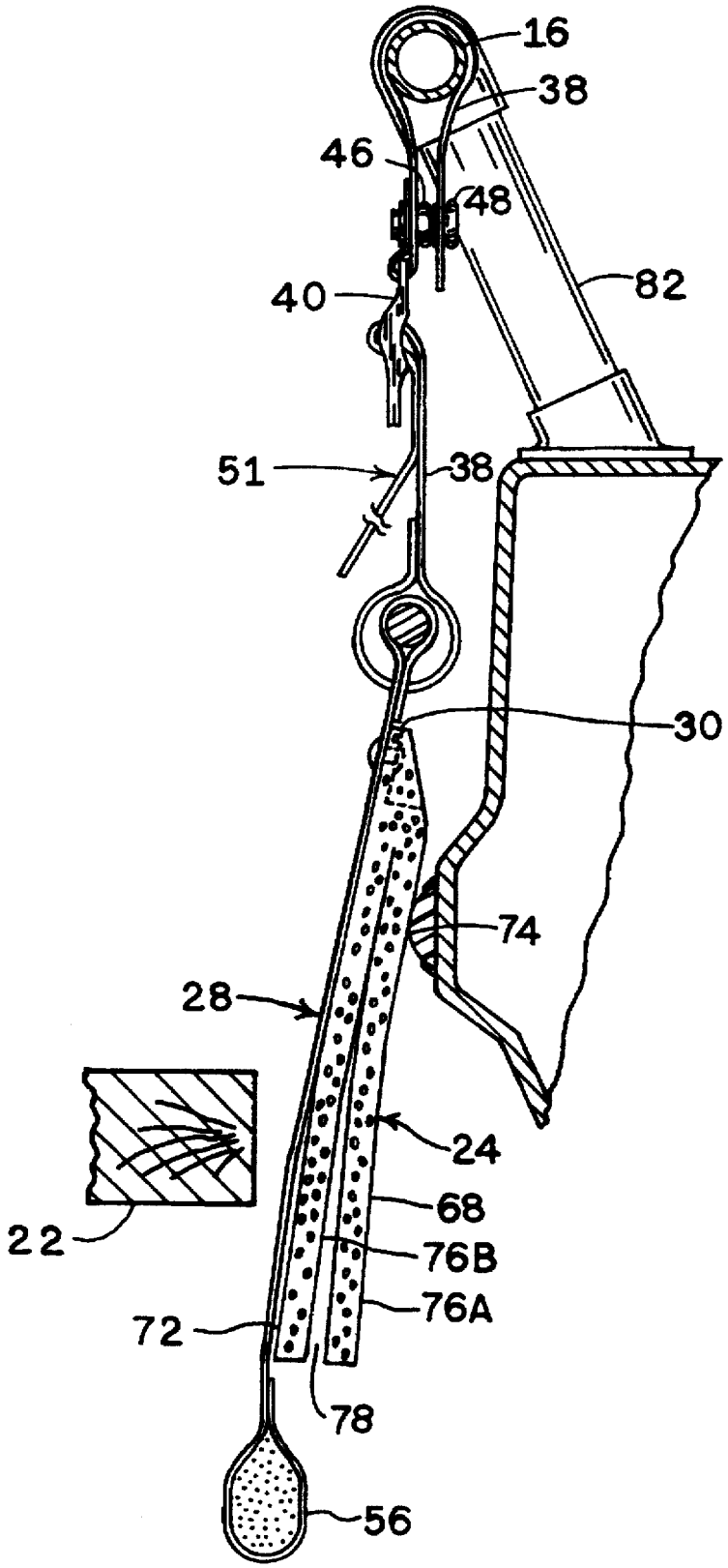
FIG. 6 is a side elevation view of an alternate embodiment of the shock absorbing assembly wherein the cushion sheet includes a cut from the bottom thereof to a locus adjacent the top.

In such circumstances, the foam may comprise a plurality of layers between the boat surface 68 and the intermediate surface 72. FIG. 6 illustrates first and second layers 76A and 76B separated by intervening cut 78. More than one cut may be used to decrease the thickness of respective layers, thereby increasing the drape of the respective thinner layers. Cut 78 generally extends from the left side 58 to the right side 60, from the bottom 64 to a locus generally at least level with where the foam will contact the outer edge 74, and generally to a point approaching the upper edge 30. In some embodiments, it is contemplated that cushion sheet may comprehend a plurality of individual layers, secured to each other and, in combination, to the slip sheet 20 through rivets 26.

Figure 7:
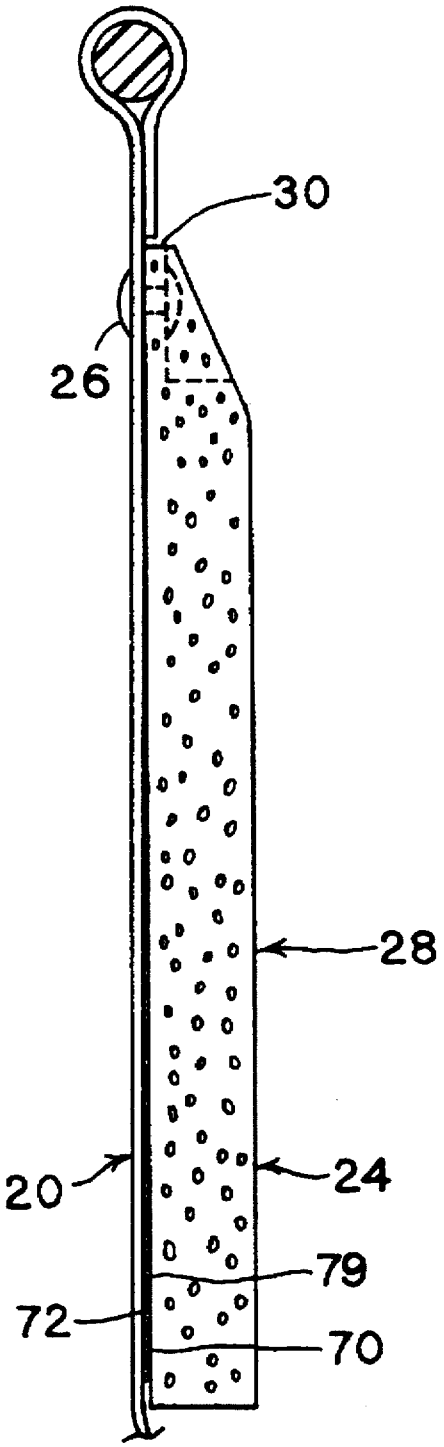
FIG. 7 shows a side elevation, in cross-section, with parts cut away, of an alternate embodiment of a shock absorbing subassembly, with the slip sheet mounted to the cushion sheet.
Figure 8:
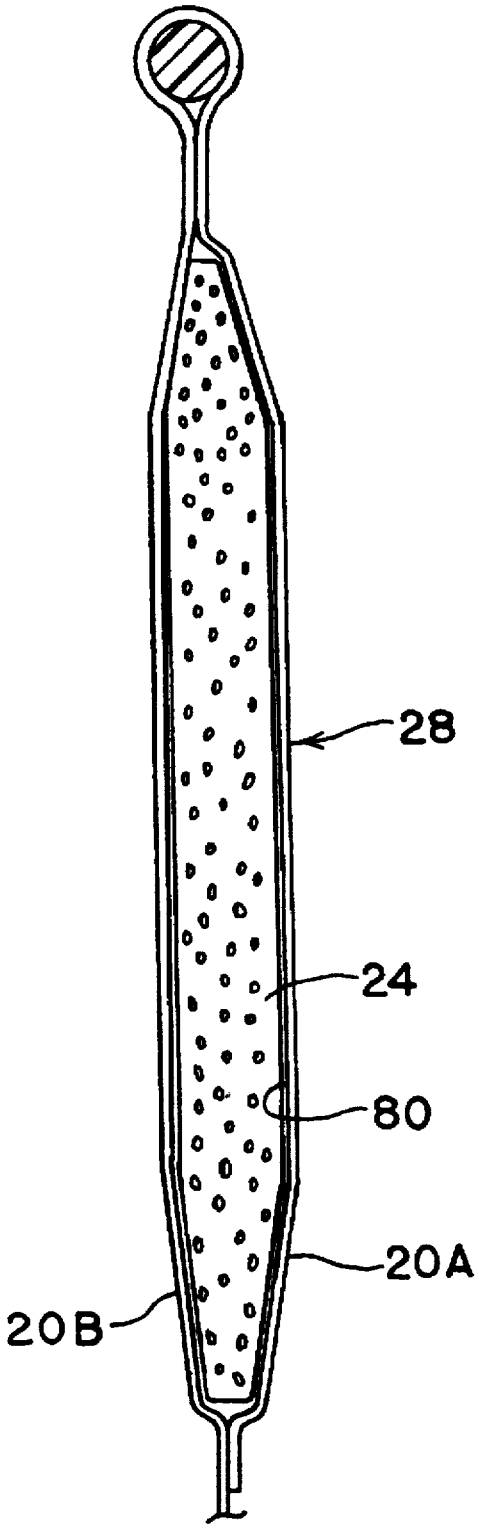
FIG. 8 shows a side elevation, in cross section, with parts cut away, of yet another embodiment of a shock absorbing subassembly, with the cushion sheet inside the slip sheet.

FIGS. 7 and 8 represent alternative embodiments of the shock absorbing subassembly. In FIG. 7, the cushion sheet 24 is bonded to the slip sheet 20 such as by a layer 79 of conventional water resistant adhesive. The illustration in FIG. 7 suggests a bonding over substantially the entire surface of the common areas of surfaces 70, 72, and so it can be. In the alternative, the surfaces 70, 72 may be bonded in e.g. a pattern providing bonding only at sufficient locations to prevent substantial movement of the slip sheet with respect to the cushion sheet. Where multiple layers of foam are used as at FIG. 6, potentially only the outermost layer e.g. 76B adjacent the slip sheet 20 is so bonded to the slip sheet.

In FIG. 8, the slip sheet 20 has first and second layers 20A and 20B secured to each other at its top and bottom, defining an enclosed space 80. Cushion sheet 24 is enclosed within the enclosed space 80, whereby slip sheet 20, in the form of the two such layers thereof, makes the surface contact with both the dock and the boat.

Regardless of which embodiment of the shock absorbing subassembly is selected for the marine fender of the invention, the suspension of the subassembly 28 from the boat at two spaced locations on the subassembly 28, in combination with respective two like spaced locations of attachment on the boat (whether at rail 16 or two boat connectors 50), assures against rolling, twisting, and the like of the fender 18 with respect to the dock and/or the boat. Rather, in all such embodiments, once the fender is installed, the dock surface side of the fender remains facing the dock, and the boat surface side of the fender remains facing the boat. Accordingly, debris and other detritus on the dock, which may be picked up by the dock surface side of the fender is not brought into facing relationship with the boat as in conventional boat fenders, whereby it cannot be brought into engaging, damaging, contact with the boat so long as the fender 18 remains properly installed on the boat.

The present invention thus provides a marine fender assembly 18 which is easy to use and mount on a number of types of water craft. The marine fender assembly 18 protects the paint or other finish on the hull from direct contact with the dock or other object to which the boat is moored. The fender assembly 18 does not transfer to the boat the debris and other detritus typically picked up from the dock or other object to which the boat is moored. The marine fender assembly accomplishes the above by maintaining a first dock surface oriented toward the dock, and a second boat surface oriented toward the boat. With the fender assembly suspended from the boat by the two spaced straps 38, the fender assembly is prevented, by the combination of (i) the configuration of the suspension and (ii) the construction of the fender assembly, from rotating about a vertical or other generally upstanding axis. Thus, the dock surface is prevented from contacting the boat with its picked-up detritus and the boat surface is prevented from contacting the dock and thus picking up detritus from the dock.

In preferred embodiments of use of the marine fender assembly 18, the boat 10 is first prepared by installing a plurality of snap connectors 50 along the outer edge of the hull 12. Referring to FIGS. 3 and 4, snap connectors 50 are preferably installed at spaced intervals along the sides of the boat. Preferred spacing for the snap connectors 50 generally corresponding with the width "W" of the marine fender assembly 18. Preferably, a front snap connector is positioned adjacent the bow of the boat and a rear snap connector is positioned adjacent the stern of the boat, with additional snap connectors generally evenly spaced between the front and rear snap connectors, as generally illustrated in FIG. 4.

Mounting the marine fender assembly 18 to the boat using the rail 16 is the easiest installation because the fender assembly 18 can be installed and used without any modification or other preparation of the boat itself. Further, to the extent the rail 16 extends the full length of the boat, the fender assembly 18 can be mounted at an infinite number of locations along the length of the boat.

However, mounting the fender assembly to the rail 16 has a number of limitations according to which it is preferred to mount the fender assembly 18 directly to the hull through snap connectors 50. First, the snap connectors 50 are installed more or less the full length of the boat, from the front boat connector 50 adjacent the bow, to the rear boat connector 50 adjacent the stern. Accordingly, in the many boats where the rail 16 extends along only part of the length of the boat, and in boats which have no rail, with the boat connectors 50 installed as discussed above, the fender assembly 18 can be installed at loci along the length of the boat where there is no rail.

Second, using snap connectors 50, the fender assembly is secured to the boat in a fixed position relative to the length of the boat, whereas a corresponding mounting of the fender assembly to a rail 16 in general does not fix the fender assembly longitudinally with respect to the length of the boat. Rather, the rail mounted fender assembly 18 can move freely along the length of the rail between any upstanding, rail support members, illustrated at e.g. 82 in FIG. 3, whereby the fender assembly 18, after installation at an optimum location, may be inadvertently moved along the rail by normal movement of the moored boat relative to the dock.

Third, since the snap connectors 50 are mounted directly to the boat hull, mounting the boat cover etc. to the boat through the combination of snap connectors 52, 46, 50 provides a rigid mount directly to the boat. By contrast, where the boat cover is mounted to the boat through a snap connector 46, with the snap connector 46 mounted to the boat through a wrapping of the corresponding strap 38 about rail 16, the cover is only indirectly mounted to the boat, since its mount depends on the loose wrapping of the strap 38 to the rail 16, which may allow considerable movement of the boat cover with respect to the boat, both up and down movement, and movement with respect to the length of the boat. Accordingly, securing the boat cover to the boat through snap connectors 52, 46, 50 is preferred.

While the description herein has described the various connectors 46, 48, 50, and the like as snap connectors, any of a wide variety of connectors may be used, so long as the respective connectors serve the connection functions described, in the environment in which the respective connectors operate.

It is contemplated that the operation and functions of the invention have become fully apparent from the foregoing description of elements, but for completeness of disclosure the usage of the invention will be briefly described.

First, the boat 10 is prepared by installing the snap connectors 50 to one or both sides of the hull 12 as described above. The marine fender assemblies may be stored elsewhere on the boat until such time as they are needed for mooring. In general, two fender assemblies 18 are used for any given boat. More than two fender assemblies 18 may be used as desired for a particular application.

When it is desired to moor the boat to e.g. a dock, the fender assemblies are typically first secured to the boat at spaced locations generally equally spaced between the front and the rear of the boat by engaging the snap connectors 46 or 48 on the fender assemblies with the snap connectors 50 on the boat. With the fender assemblies 18 so secured to the boat hull, the fender assemblies are hung over the side of the boat, generally as shown in FIG. 1.

The boat is then brought adjacent the dock at a location favorable for mooring the boat to the dock, with the fender assemblies interposed between the boat and the dock. The boat is then tied or otherwise secured to the dock as desired. With the boat generally fixed length-wise in location with respect to the dock, the user can then determine whether moving either of the fender assemblies, either frontward or rearward to another position along the side of the boat will enhance the protection provided by the respective fender assemblies. The user thus selects preferred boat connectors 50 for mounting the fender assemblies in positions most advantageous for protecting the boat from the dock. To the extent the preferred boat connectors 50 differ from the boat connectors where the fender assemblies are already mounted to the boat, the fender assemblies are disconnected from the boat connectors and are reconnected at the selected preferred boat connectors, to thereby provide increased protection to the boat.

The two straps 38 on each fender assembly 18 are connected to first and second spaced ones of the boat connectors 50. The two straps 38 are generally not connected to the same one boat connector 50, since connection of the fender assembly to the boat at a single common location might allow undesirable rotation of the fender assembly about a vertical axis, which is not preferred for use of the fender assemblies of the invention.

As an expedient, the user can mount the fender assemblies of the invention to a boat using already installed snap connectors, such as snap connectors previously installed on the boat such as for mounting a boat cover to the boat. Similarly, one can mount the fender assemblies to the rail 16 as shown. In addition, the user can mount the fender assemblies by securing one strap 38 to a rail 16 and the second strap 38 to a boat or other snap connector, with the first strap mounted over rail 16 and the second strap mounted to a conveniently located connector. However, any deviation from the preferred mounting using the evenly spaced snap connectors 50 bears the disadvantage of a more limited number of potential locations for hanging the fender assemblies 18 along the side of the boat. This, of course, respectively may reduce the user's ability to position the fender assembly for optimum protection of the boat from impact against the dock when the boat is moored at a particular location.

All the above description of mooring the boat to a dock generally addresses mooring the boat to a stationary dock, secured to land. However, with little or no adaptation, the same principles apply to mooring the boat to floating objects such as floating docks, floating barges, other boats and the like.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A marine fender assembly for mounting to a boat, and for thus being interposed between the boat and a second object, thereby protecting the hull of the boat when the boat is moored to the second object, said marine fender assembly comprising:

(a) a slip sheet;

(b) a cushion sheet mounted to said slip sheet; and (c) a fastener subassembly secured to one of said slip sheet and said cushion sheet for hanging said marine fender assembly downwardly from a mounting locus on the boat and thereby interposing said marine fender assembly between the boat and the second object, said cushion sheet contacting and following movement of the boat hull, said slip sheet contacting and following movement of the second object, whereby sliding movement resulting from movement of the boat relative to the second object is substantially absorbed and dissipated by corresponding sliding movements within said marine fender assembly.

2. A marine fender assembly as in claim 1, said fastener subassembly comprising strap apparatus extending from at least one of said slip sheet and said cushion sheet for encircling engagement with a rail on the boat, and including first and second spaced connectors engageable with each other to define a loop around the rail.

3. A marine fender assembly as in claim 2, said strap apparatus including adjustment apparatus on a strap for selectively varying the length of said strap.

4. A marine fender assembly as in claim 1, said fastener subassembly comprising first and second spaced strap apparatuses each extending from at least one of said slip sheet and said cushion sheet, for hanging said marine fender assembly downwardly from a mounting locus on the boat and thereby interposing said marine fender assembly between the boat and the second object.

5. A marine fender assembly as in claim 1, said fastener subassembly comprising strap apparatus, and a connector mounted on said strap apparatus and engageable with a mating connector on the boat.

6. A marine fender assembly as in claim 5, said connector having opposing first and second engagement elements on opposing sides thereof corresponding to opposing sides of a strap of said strap apparatus, the first said engagement element being disposed for engaging a respective mating connector on the boat, and the second said engagement element being disposed for engaging a corresponding connector on a third object to thereby secure the third object to the boat.

7. A marine fender assembly as in claim 1, said cushion sheet having a top and a bottom, left and right sides, a front and a back, a thickness between the front and the back, and first and second layers separated by an intervening cut, between the front and the back, extending from the left side to the right side, and from the bottom to a locus at least adjacent the top.

8. A marine fender assembly as in claim 1, said cushion sheet being mounted to said slip sheet such that a first side of said cushion sheet disposed toward the second object is prevented from rotating into facing orientation with respect to said boat hull.

9. A marine fender assembly as in claim 1, said cushion sheet being mounted to said slip sheet such that both said slip sheet and said cushion sheet maintain a common orientation with respect to each other during normal movement of the moored boat.

10. A marine fender assembly as in claim 1, said cushion sheet and said slip sheet being secured to each other to form a cushioned shock absorbing subassembly, said fastener subassembly comprising first and second strap apparatuses secured to said shock absorbing subassembly at laterally spaced locations, for hanging said shock absorbing subassembly downwardly from respective first and second spaced mounting loci on the boat.

11. A marine fender assembly as in claim 10, said shock absorbing subassembly having left and right sides, said first and second strap apparatuses being secured respectively to said shock absorbing subassembly adjacent respective ones of said left and right sides.

12. A marine fender assembly for mounting to a boat, and for thus being interposed between the boat and a second object, thereby protecting the hull of the boat when the boat is moored to the second object, said marine fender assembly comprising:

(a) a slip sheet;

(b) a cushion sheet mounted to said slip sheet for sliding movement thereagainst and such that a first side of said cushion sheet, disposed toward the second object, is prevented from rotating into facing orientation with respect to the boat hull; and (c) a fastener subassembly comprising first and second spaced strap apparatuses each extending from at least one of said slip sheet and said cushion sheet, for hanging said marine fender assembly downwardly from a mounting locus on the boat and thereby interposing said marine fender assembly between the boat and the second object.

13. A marine fender assembly as in claim 12, said cushion sheet having a top and a bottom, left and right sides, a front and a back, a thickness between the front and the back, and first and second layers separated by an intervening cut, between the front and the back, extending from the left side to the right side, and from the bottom to a locus at least adjacent the top.

14. A marine fender assembly as in claim 12, said cushion sheet being mounted to said slip sheet such that both said slip sheet and said cushion sheet maintain a common orientation with respect to each other during normal movement of the moored boat.

15. A marine fender assembly as in claim 12, said cushion sheet and said slip sheet being secured to each other to form a cushioned shock absorbing subassembly.

16. A marine fender assembly as in claim 15, said shock absorbing subassembly having left and right sides, said first and second strap apparatuses being secured respectively to said shock absorbing subassembly adjacent respective ones of said left and right sides.

17. A marine fender assembly as in claim 12, said cushion sheet being made with a resiliently compressible ethylene vinyl acetate foam having a density of about 1 to about 10 pounds per cubic foot.

18. A marine fender assembly for mounting to a boat, and for thus being interposed between the boat and a second object, thereby protecting the hull of the boat when the boat is moored to the second object, said marine fender assembly comprising:

(a) a slip sheet;

(b) a cushion sheet mounted to said slip sheet for sliding movement thereagainst and such that both said slip sheet and said cushion sheet maintain a common orientation with respect to each other during normal movement of the moored boat; and (c) a fastener subassembly comprising a strap apparatus, and a connector mounted on said strap apparatus and engageable with a mating connector on the boat, said strap apparatus being secured to at least one of said slip sheet and said cushion sheet for hanging said marine fender assembly downwardly from a mounting locus on the boat and thereby interposing said marine fender assembly between the boat and the second object.

19. A marine fender assembly as in claim 18, said connector having opposing first and second engagement elements on opposing sides thereof corresponding to opposing sides of a strap of said strap apparatus, the first said engagement element being disposed for engaging a respective mating connector on the boat, and the second said engagement element being disposed for engaging a corresponding connector on a third object to thereby secure the third object to the boat.

20. A marine fender assembly as in claim 18, said cushion sheet having a top and a bottom, left and right sides, a front and a back, a thickness between the front and the back, and first and second layers separated by an intervening cut, between the front and the back, extending from the left side to the right side, and from the bottom to a locus at least adjacent the top.

21. A marine fender assembly as in claim 18, said slip sheet comprising first and second opposing layers, and a space between said first and second layers, said cushion sheet being contained substantially within the space.

22. A marine fender assembly as in claim 18, said cushion sheet being made with a resiliently compressible ethylene vinyl acetate foam having a density of about 1 to about 10 pounds per cubic foot.

23. A marine fender assembly as in claim 18, said slip sheet having an upper edge when installed on the boat, said cushion sheet being mounted to said slip sheet such that said cushion sheet hangs from said slip sheet adjacent said upper edge thereof and is disposed between said slip sheet and the boat hull.

24. A marine fender assembly as in claim 18, the mounting of said cushion sheet to said slip sheet being effective to accommodate sliding movement resulting from movement of the boat relative to the second object being substantially absorbed and dissipated by corresponding sliding movement within said marine fender assembly.

25. A marine fender assembly for mounting to a boat, and for thus being interposed between the boat and a second object, thereby protecting the hull of the boat when the boat is moored to the second object, said marine fender assembly comprising:

(a) a slip sheet;

(b) a cushion sheet, said cushion sheet and said slip sheet being secured to each other to form a cushioned shock absorbing subassembly, a facing surface of said cushion sheet covering substantially an entire facing surface of said slip sheet; and (c) first and second elongate fastener assemblies secured to said shock absorbing subassembly at laterally spaced locations on said shock absorbing subassembly, for hanging said shock absorbing subassembly downwardly from a mounting locus on the boat and thereby interposing said shock absorbing subassembly between the boat and the second object.

26. A marine fender assembly as in claim 25, said shock absorbing subassembly having a top edge, and left and right ends communicating with said top edge, said first and second elongate fastener assemblies being secured respectively to said shock absorbing subassembly adjacent the left and right ends, for upward securement therefrom to spaced locations on the mounting locus.

27. A marine fender assembly as in claim 25, said first and second elongated fastener assemblies comprising strap apparatuses extending from said shock absorbing subassembly for encircling engagement with a rail on the boat, each said strap apparatus including first and second spaced connectors engageable with each other to define a loop around the rail.

28. A marine fender assembly as in claim 27, each said strap apparatus including adjustment apparatus on a respective strap for selectively varying the length of the respective said strap.

29. A marine fender assembly as in claim 25, said first and second strap apparatuses comprising connectors mounted thereon, engageable with respective mating connectors at laterally spaced locations along the length of the boat.

30. A marine fender assembly as in claim 25, said slip sheet comprising first and second opposing layers, and a space between said first and second layers, said cushion sheet being contained substantially within the space.

31. A marine fender assembly as in claim 25, the mounting of said cushion sheet to said slip sheet being effective to prevent movement of said slip sheet with respect to said cushion sheet over substantially the entirety of facing surfaces of said slip sheet and said cushion sheet.

32. A marine fender assembly as in claim 25, the securement of said cushion sheet and said slip sheet to each other being effective to accommodate sliding movement resulting from movement of the boat relative to the second object being substantially absorbed and dissipated by corresponding sliding movement within said marine fender assembly.

33. A marine fending system, comprising:

(a) a boat, having a hull comprising a bow, a stern, a length between said bow and said stern, first and second sides, and an outer edge about an outer perimeter of said hull, said boat including a connector permanently mounted to said hull of said boat;

(b) a marine fender assembly mounted to said boat, said marine fender assembly including (i) a slip sheet, (ii) a cushion sheet mounted to said slip sheet to form a cushioned shock absorbing subassembly, and (iii) a fastener subassembly secured to at least one of said slip sheet and said cushion sheet for hanging said cushioned shock absorbing subassembly downwardly from a mounting locus on said boat and thereby interposing said shock absorbing subassembly between said boat and a second object, said fastener subassembly comprising strap apparatus including adjustment apparatus on a strap for selectively varying the length of said strap, a mating connector disposed on said strap apparatus and engaged to said connector on said boat.

34. A marine fending system as in claim 33, said mating connector having opposing first and second engagement elements on opposing sides thereof corresponding to opposing sides of said strap of said strap apparatus, the first said engagement element on said mating connector being engaged to said connector on said boat, and the second said engagement element on said mating connector being engaged to a corresponding connector on a third object, thereby securing the third object to said boat.

35. A marine fending system as in claim 33, said slip sheet comprising first and second opposing layers, and a space between said first and second layers, said cushion sheet being contained substantially within the space.

36. A marine fending system as in claim 33, the mounting of said cushion sheet to said slip sheet being effective to prevent movement of said slip sheet with respect to said cushion sheet over substantially the entirety of facing surfaces of said slip sheet and said cushion sheet.

37. A marine fender assembly for mounting to a boat, and for thus being interposed between the boat and a second object, thereby protecting the hull of the boat when the boat is moored to the second object, said marine fender assembly comprising:

(a) a slip sheet;

(b) a cushion sheet mounted to said slip sheet, said cushion sheet having a top and a bottom, left and right sides, a front and a back, and a thickness between the front and the back, first and second layers separated by an intervening cut, between the front and the back, extending from the left side to the right side, and from the bottom to a locus at least adjacent the top;

(c) a fastener subassembly secured to at least one of said slip sheet and said cushion sheet for hanging said marine fender assembly downwardly from a mounting locus on the boat and thereby interposing said marine fender assembly between the boat and the second object, said intervening cut providing an increased angle of downward vertical draping to said cushion sheet relative to an uncut cushion sheet of the same thickness.

38. A marine fender assembly as in claim 37, said fastener subassembly comprising strap apparatus extending from one of said slip sheet and said cushion sheet for encircling engagement with a rail on the boat, said strap apparatus including first and second spaced connectors engageable with each other to define a loop around the rail.

39. A marine fender assembly as in claim 38, said fastener subassembly comprising strap apparatus extending from one of said slip sheet and said cushion sheet, including adjustment apparatus on said strap apparatus for selectively varying the length of a strap.

40. A marine fender assembly as in claim 37, said fastener subassembly comprising a strap extending from one of said slip sheet and said cushion sheet, said strap comprising a connector mounted thereon, engageable with a mating connector on the boat.

41. A marine fender assembly as in claim 40, said connector having opposing first and second engagement elements on opposing sides thereof corresponding to opposing sides of said strap, the first said engagement element on said connector being disposed for engaging a respective mating connector on the boat, and the second said engagement element on said connector being disposed for engaging a corresponding connector on a third object to thereby secure the third object to the boat.

42. A marine fender assembly as in claim 37, the mounting of said cushion sheet to said slip sheet, and said cut, in combination, being effective to accommodate sliding movement resulting from movement of the boat relative to the second object being substantially absorbed and dissipated by corresponding sliding movement within said marine fender assembly.

43. A marine fender assembly for mounting to a boat, and for thus being interposed between the boat and a second object, thereby protecting the hull of the boat when the boat is moored to the second object, said marine fender assembly comprising:

(a) a slip sheet;

(b) a cushion sheet mounted to said slip sheet for sliding movement thereagainst and such that a first side of said cushion sheet, disposed toward the second object, is prevented from rotating into facing orientation with respect to the boat hull; and (c) a fastener subassembly comprising a strap apparatus extending from at least one of said slip sheet and said cushion sheet for encircling engagement with a rail on the boat, and including first and second spaced connectors engageable with each other and adopted to define a loop around the rail, said strap apparatus for hanging said marine fender assembly downwardly from a mounting locus on the boat.

44. A marine fender assembly as in claim 43, said strap apparatus including adjustment apparatus on a strap for selectively varying the length of said strap.

45. A marine fender assembly for mounting to a boat, and for thus being interposed between the boat and a second object, thereby protecting the hull of the boat when the boat is moored to the second object, said marine fender assembly comprising:

(a) a slip sheet;

(b) a cushion sheet mounted to said slip sheet for sliding movement thereagainst and such that a first side of said cushion sheet, disposed toward the second object, is prevented from rotating into facing orientation with respect to said boat hull; and (c) a fastener subassembly secured to at least one of said slip sheet and said cushion sheet for hanging said marine fender assembly downwardly from a mounting locus on the boat and thereby interposing said marine fender assembly between the boat and the second object, the mounting of said cushion sheet to said slip sheet being effective to accommodate sliding movement resulting from movement of the boat relative to the second object being substantially absorbed and dissipated by corresponding sliding movement within said marine fender assembly.

46. A marine fender assembly as in claim 45, said fastener subassembly comprising strap apparatus extending from at least one of said slip sheet and said cushion sheet for encircling engagement with a rail on the boat, and including first and second spaced connectors engageable with each other to define a loop around the rail.

47. A marine fender assembly as in claim 46, said strap apparatus including adjustment apparatus on a strap for selectively varying the length of said strap.

48. A marine fender assembly as in claim 45, said fastener subassembly comprising first and second spaced strap apparatus each extending from at least one of said slip sheet and said cushion sheet, for hanging said marine fender assembly downwardly from a mounting locus on the boat and thereby interposing said marine fender assembly between the boat and the second object.

49. A marine fender assembly as in claim 45, said fastener subassembly comprising strap apparatus, and a connector mounted on said strap apparatus and engageable with a mating connector on the boat.

50. A marine fender assembly as in claim 49, said connector having opposing first and second engagement elements on opposing sides thereof corresponding to opposing sides of a strap of said strap apparatus, the first said engagement element being disposed for engaging a respective mating connector on the boat, and the second said engagement element being disposed for engaging a corresponding connector on a third object to thereby secure the third object to the boat.

51. A marine fender assembly as in claim 45, said cushion sheet having a top and a bottom, left and right sides, a front and a back, a thickness between the front and the back, and first and second layers separated by an intervening cut, between the front and the back, extending from the left side to the right side, and from the bottom to a locus at least adjacent the top.

52. A marine fender assembly as in claim 45, said cushion sheet being mounted to said slip sheet such that both said slip sheet and said cushion sheet maintain a common orientation with respect to each other during normal movement of the moored boat.

53. A marine fender assembly as in claim 45, said cushion sheet and said slip sheet being secured to each other to form a cushioned shock absorbing subassembly, said fastener subassembly comprising first and second strap apparatuses secured to said shock absorbing subassembly at laterally spaced locations on said shock absorbing subassembly, for hanging said shock absorbing subassembly downwardly from respective first and second spaced mounting loci on the boat.

54. A marine fender assembly as in claim 45, said shock absorbing subassembly having left and right sides, said first and second strap apparatuses being secured respectively to said shock absorbing subassembly adjacent respective ones of said left and right sides.

55. A marine fender assembly as in claim 45, said cushion sheet being made with a resiliently compressible ethylene vinyl acetate foam having a density of about 1 to about 10 pounds per cubic foot.

* * * * *